US005307966A

United States Patent [19]

Inaba et al.

[11] Patent Number: 5,307,966

[45] Date of Patent: May 3, 1994

[54] STRAPPING STRUCTURE FOR AN INSTRUMENT AND THE LIKE

[75] Inventors: Toshiya Inaba, Tokyo; Masahiro Koinuma, Saitama, both of Japan

[73] Assignee: Asahi Kogaku Kogyo Kabushiki Kaisha, Tokyo, Japan

[21] Appl. No.: 853,119

[22] Filed: Mar. 18, 1992

[30] Foreign Application Priority Data

Mar. 18, 1991 [JP] Japan ..... 3-040445[U]

[51] Int. Cl.[5] ..... A45C 13/30

[52] U.S. Cl. ..... 224/151; 224/202; 224/206, 207, 218-222, 254/258, 264, 267, 908, 224/908; 224/909; 24/115 A; 24/129 A; 24/163 K; 24/664

[58] Field of Search ..... 224/151, 296, 202, 205, 224/206, 207, 218-222, 254, 258, 264, 267, 908, 909, 910; 24/3 B, 3 L, 3 M, 3 R, 16 R, 115 A, 115 K, 115 G, 129 A, 163 K, 662, 664; 403/309-311, 313, 393, 396, 397

[56] References Cited

U.S. PATENT DOCUMENTS

| | | | |
|---|---|---|---|
| 732,270 | 6/1903 | Bowman | 24/115 A |
| 1,412,679 | 4/1922 | Fasson | 224/267 |
| 1,637,003 | 7/1927 | Lang | 224/258 |
| 1,790,695 | 2/1931 | Behrman | 24/115 A |
| 2,269,285 | 1/1942 | Ott | 403/393 X |
| 2,319,747 | 5/1943 | Osborne | 24/115 A |
| 2,356,209 | 8/1944 | Brilhart | 224/258 |
| 3,346,155 | 10/1967 | Oechsle | 224/205 |
| 3,466,712 | 9/1969 | Behney | 24/115 A |
| 3,522,766 | 8/1970 | Wolbarst | 224/908 X |
| 3,545,659 | 12/1970 | Libby | 224/202 |
| 4,233,714 | 11/1980 | Panicci | 24/664 |
| 4,322,077 | 3/1982 | Van't Hof | 224/219 X |
| 4,570,688 | 2/1986 | Williams | 224/205 X |
| 4,887,318 | 12/1989 | Weinreb | 224/264 X |
| 5,074,439 | 12/1991 | Wilcox | 224/222 X |
| 5,082,156 | 1/1992 | Braun | 224/220 |

*Primary Examiner*—J. Casimer Jacyna

*Attorney, Agent, or Firm*—Kane, Dalsimer, Sullivan, Kurucz, Levy, Eisele and Richard

[57] ABSTRACT

A strapping structure for an optical instrument such as a camera, a video camera, a binocular and so on, which is capable of performing as more than two straps having different functions such as a grip strap and a shoulder strap. The strapping structure comprises a loop-shaped strap which is installed on the camera body, and a stopper provided on an intermediate portion of the loop-shaped strap. The stopper is shiftable along a longitudinal direction of the strap, and forms a large loop-shaped first strap serving for example as a shoulder strap and a small loop-shaped second strap serving for example as a grip strap. The loop-shaped strap, which is positioned adjacent to the camera body, is provided with a pad. This pad can be used as a pad receiving a back of hand or a shoulder pad.

8 Claims, 9 Drawing Sheets

STRAPPING STRUCTURE FOR AN INSTRUMENT AND THE LIKE

BACKGROUND OF THE INVENTION

The present invention relates to a strapping structure for an instrument and the like, for example an optical instrument such as a camera, a video camera, a binocular and so on, and particularly to a strapping structure which is capable of performing at least two different functions.

Conventionally, this kind of strapping structure is constituted in such a manner that a shoulder strap is inserted into rings on a camera body and both ends of the shoulder strap are connected together so as to form a loop. And, an adjuster for adjusting loop length is equipped with the connecting portion of the shoulder strap in order to adapt the loop length according to the size of a use of the camera.

On the other hand, it is conventional to equip a video camera with a grip strap as another strapping structure for stably holding a hand of the user the palm of which hand supports a bottom portion of the video camera and four fingers except the thumb of which are set to extend upright along the side surface of the video camera.

If a user wants to stably hold the camera, it would be necessary to equip with the grip strap further to the shoulder strap, while a user wants to easily carry the video camera, it would be necessary to equip with the shoulder strap further to the grip strap. As a result, a number of members which should be equipped with the camera or the video camera for holding and carrying would be undesirably increased.

SUMMARY OF THE INVENTION

It is therefore an object of the present invention to provide an improved strapping structure for an instrument and the like, for example a camera, a video camera, a binocular and so on, which is capable of performing as more than two straps having different functions such as a grip strap and a shoulder strap.

According to the present invention, there is provided a strapping structure for an instrument comprising a loop-shaped strap adapted to be installed on said instrument; and a stopper provided on an intermediate portion of said loop for binding said loop to form a first loop portion and a second loop portion said stopper being shiftable along a longitudinal direction of said strap, whereby proportion of said first and second loop portions to each other is changeable.

The loop-shaped strap, which is positioned adjacent to the optical instrument, is provided with a pad. This pad can be used as a pad receiving a back of hand or a shoulder pad.

The above and other objects, features and advantages of the present invention will become more apparent from the following detailed description which is to be read in conjunction with the accompanying drawings.

DESCRIPTION OF THE ACCOMPANYING DRAWINGS

Figure 3A:
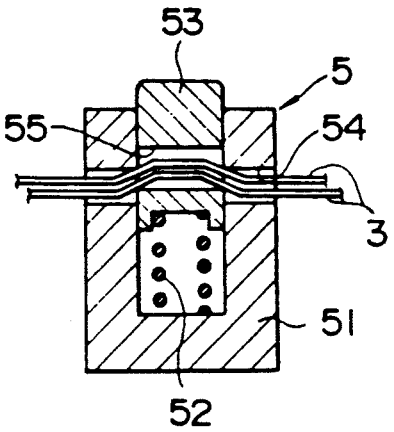
Figure 3B:
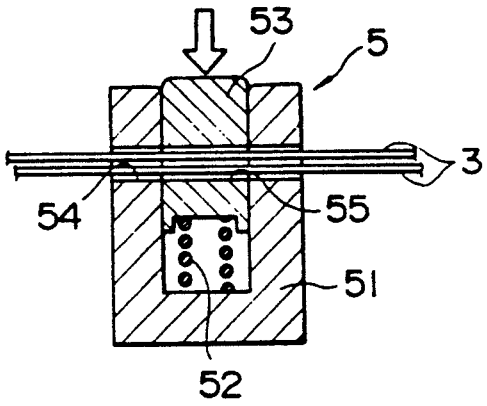
Figure 4:
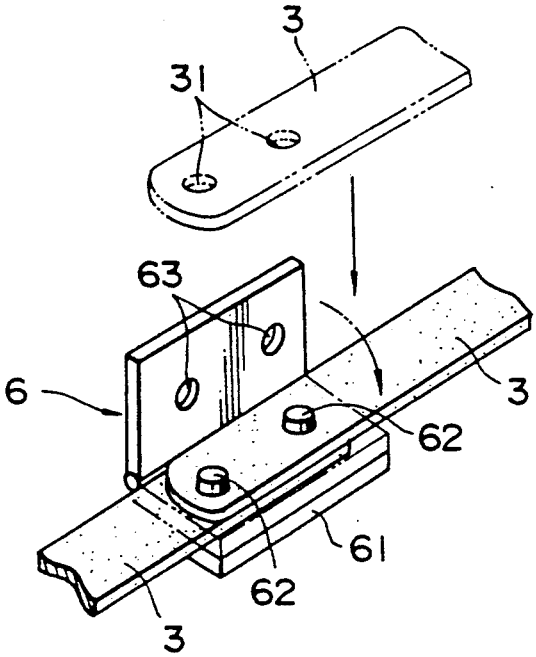
Figure 5A:
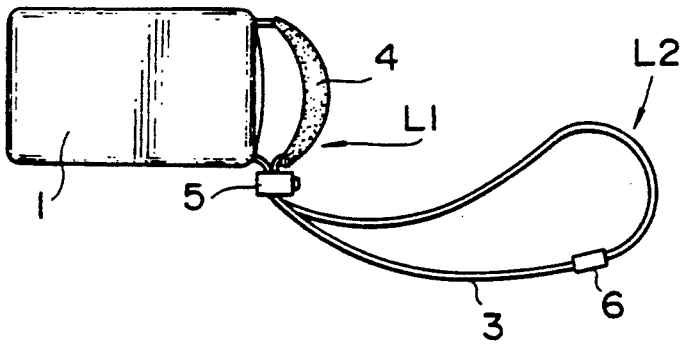
Figure 5B:
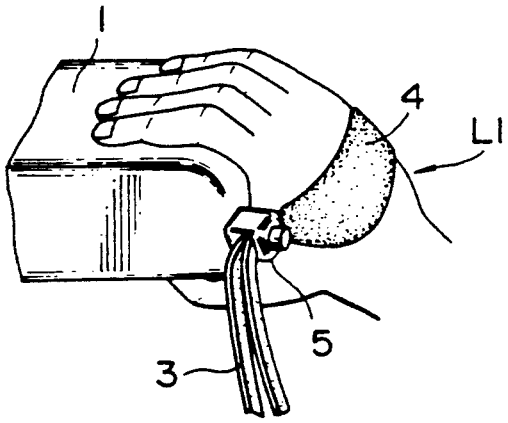
Figure 5C:
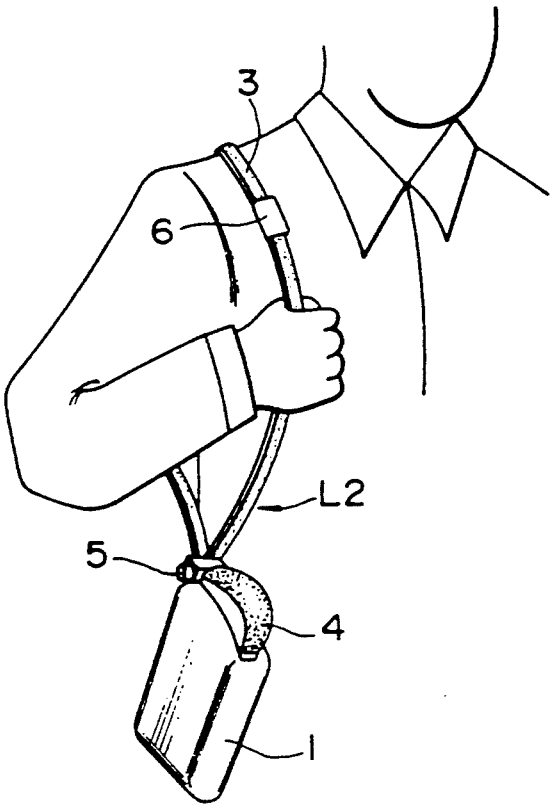
Figure 6A:
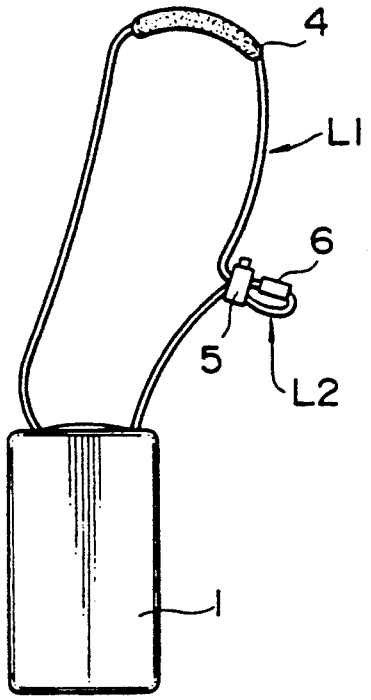
Figure 6B:
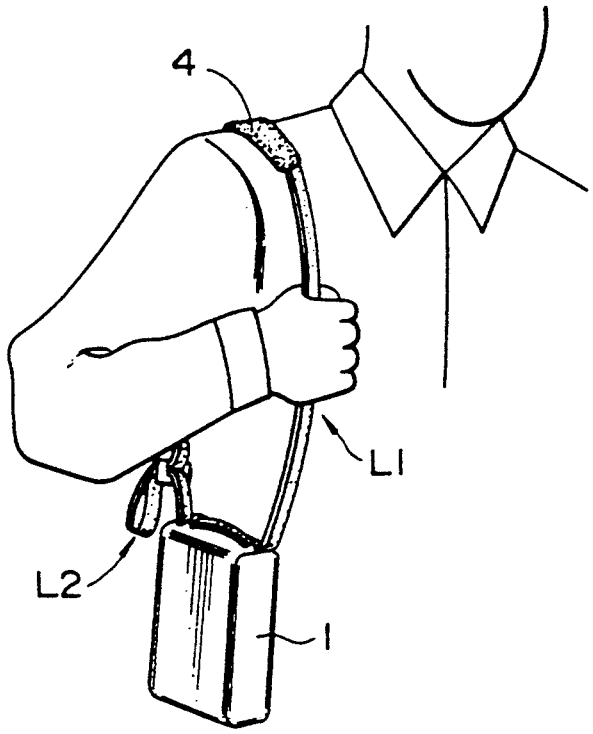
Figure 7:
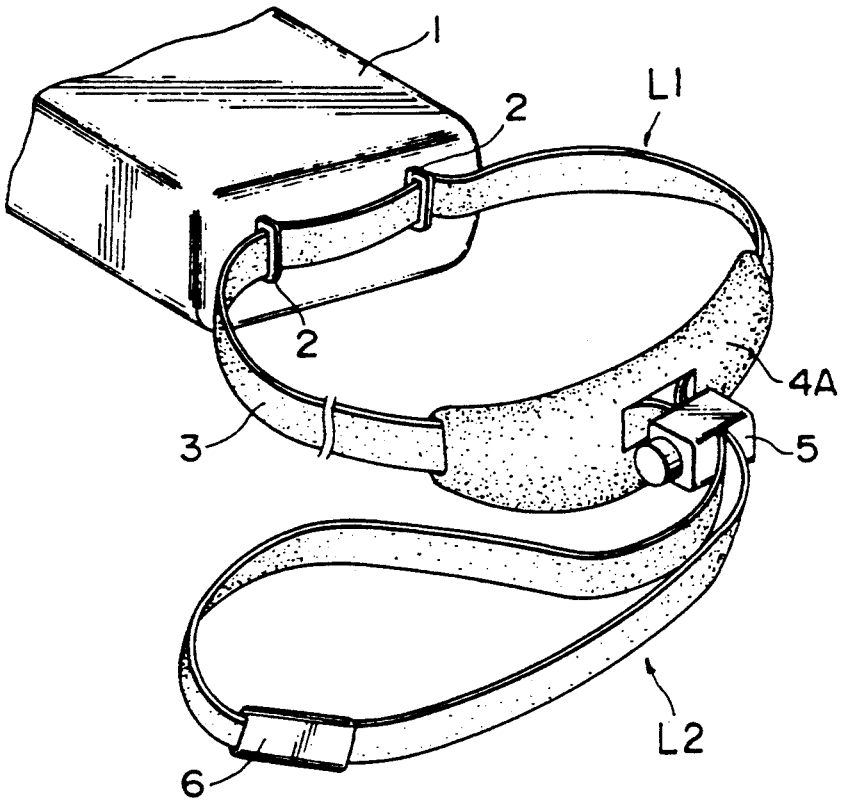
Figure 8:
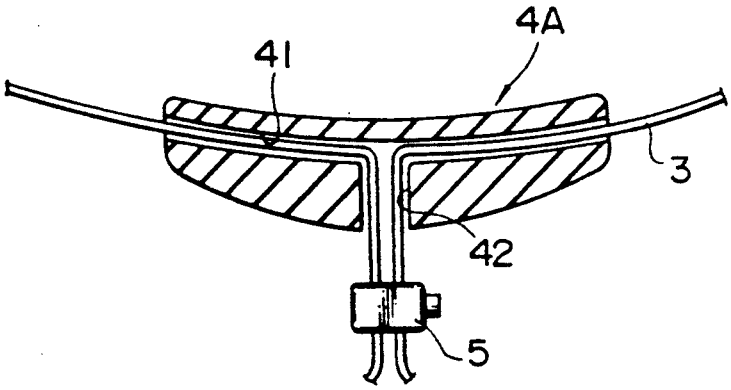
Figure 9A:
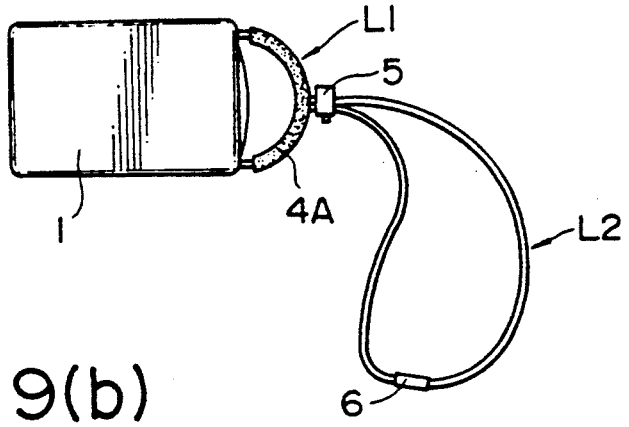
Figure 9B:
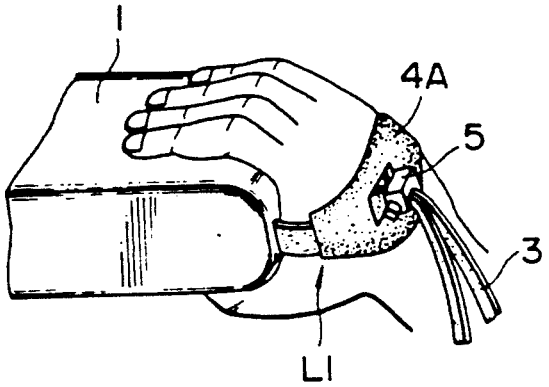
Figure 9C:
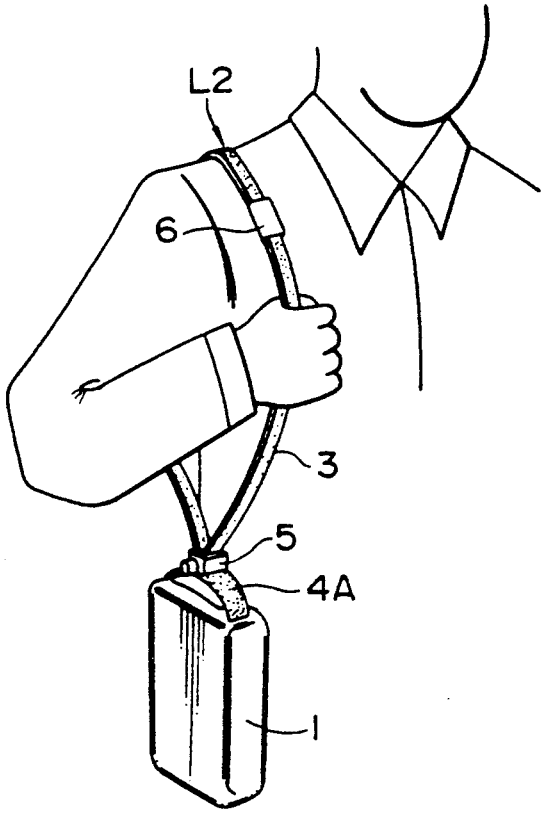
Figure 10A:
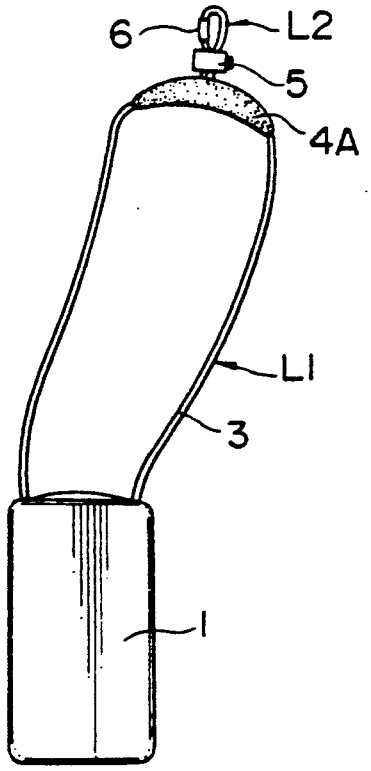
Figure 10B:
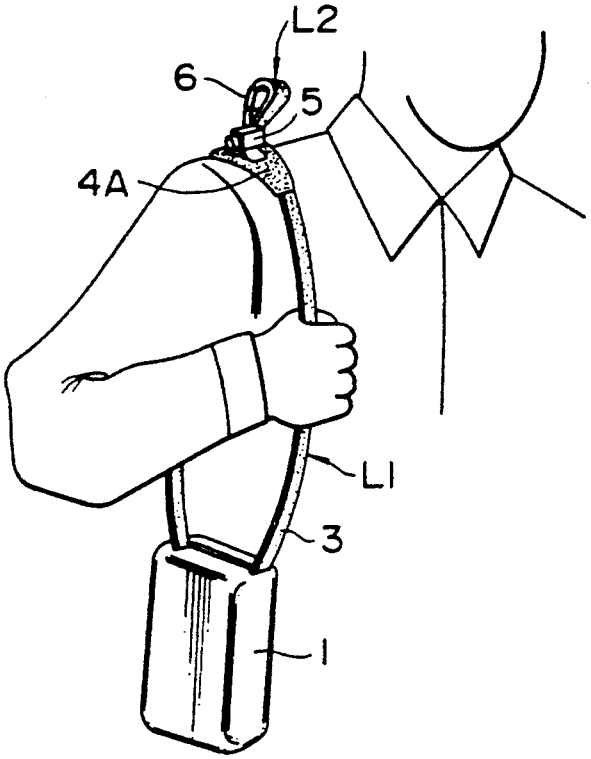
Figure 11A:
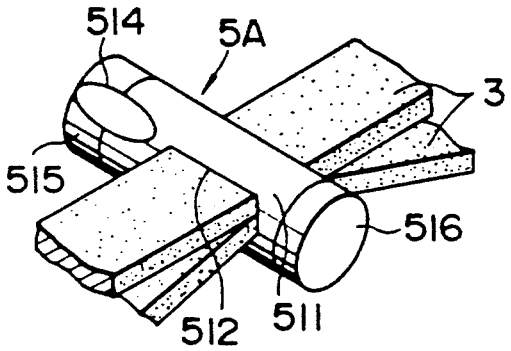
Figure 11B:
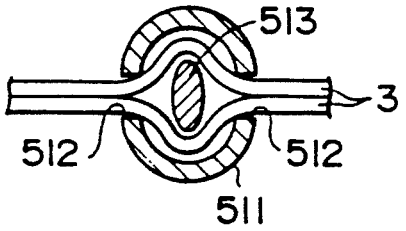
Figure 11C:
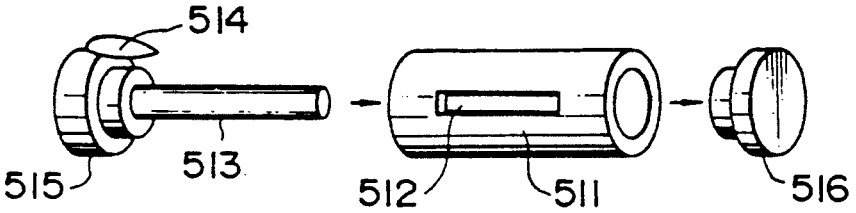
Figure 11D:
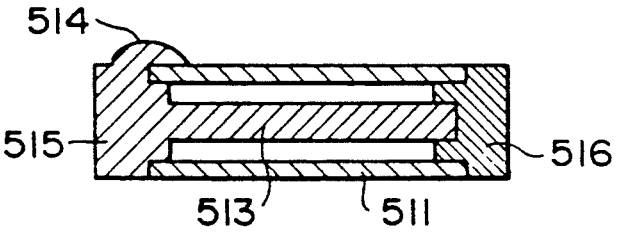
Figure 11E:
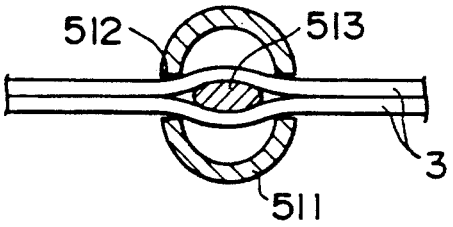
Figure 12A:
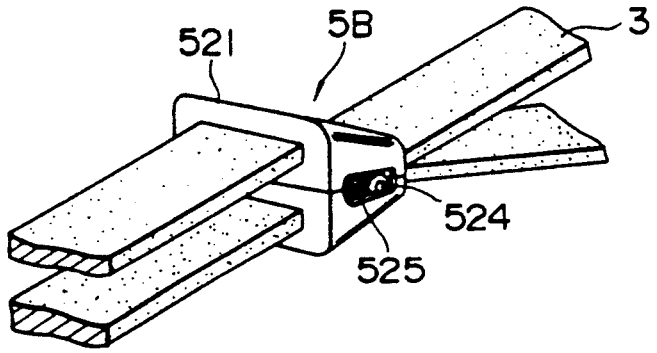
Figure 12B:
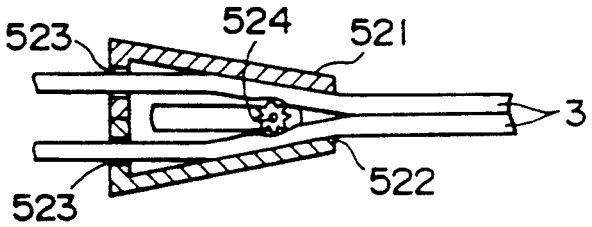
Figure 12C:
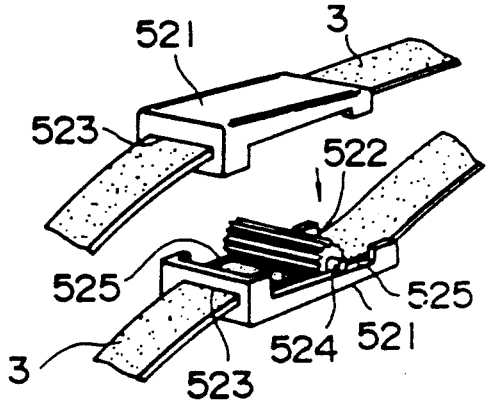

FIGS. 3(*a*) and 3(*b*) are views illustrating operation of a first embodiment of a stopper;

FIG. 4 is a perspective view showing an end fastener;

FIGS. 5(*a*), 5(*b*), and 5(*c*) are perspective views showing conditions of the first embodiment in which a grip strap is mainly utilized;

FIGS. 6(*a*) and 6(*b*) are perspective views showing conditions of the first embodiment wherein the strap is adjusted as a shoulder strap;

FIG. 7 is a perspective view showing an essential part of a second embodiment of the present invention;

FIG. 8 is a cross-sectional view showing a pad;

FIGS. 9(*a*), 9(*b*), and 9(*c*) are perspective views showing conditions of the second embodiment in which a grip strap is mainly utilized;

FIGS. 10(*a*) and 10(*b*) are perspective views showing conditions of the second embodiment wherein the strap is adjusted as a shoulder strap;

FIG. 11(*a*) is a perspective view showing an appearance of a second embodiment of the stopper;

FIGS. 11(*b*) and 11(*e*) are a cross-sectional views showing the second embodiment of the stopper;

FIG. 11(*c*) is an explanatory view illustrating how to assemble the second embodiment of the stopper;

FIG. 11(*d*) is a cross-sectional view showing the second embodiment of the stopper;

FIG. 12(*a*) is a perspective view showing an appearance of a third embodiment of the stopper;

FIG. 12(*b*) is a cross-sectional view showing the third embodiment of the stopper; and FIG. 12(*c*) is a perspective exploded view showing the third embodiment of the stopper.

DESCRIPTION OF THE EMBODIMENT

Figure 1:
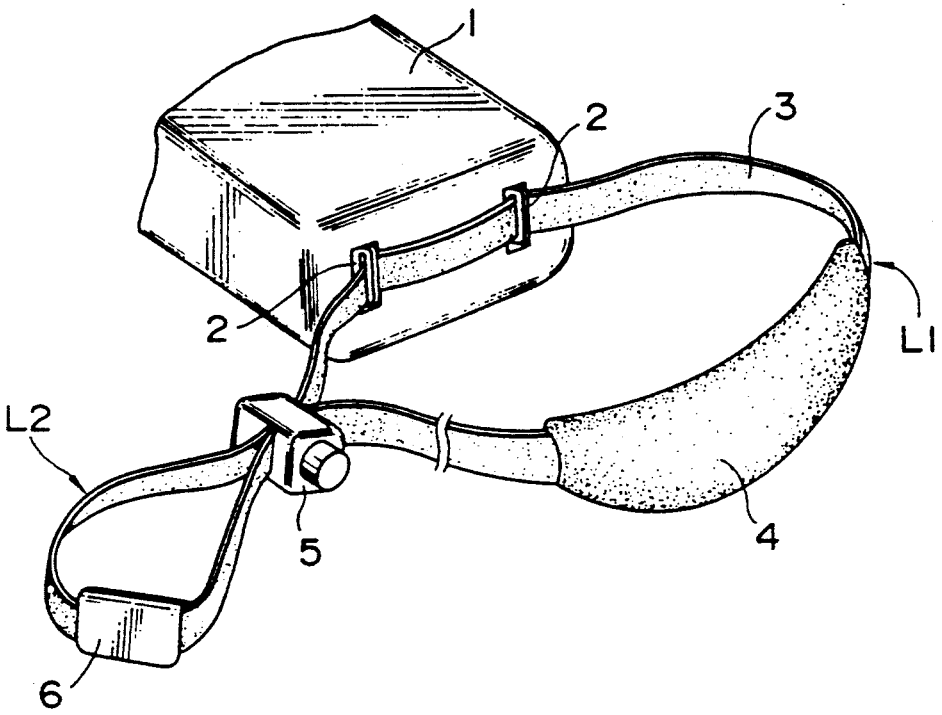
FIG. 1 is a perspective view showing an essential part of a first embodiment of the present invention.
Figure 2:
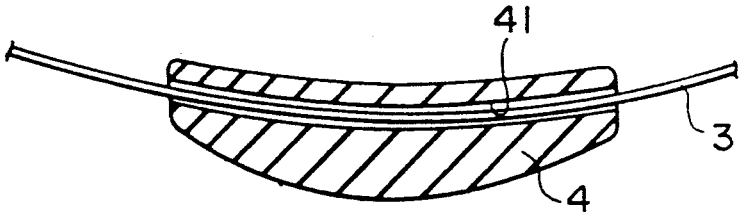
FIG. 2 is a cross-sectional view showing a pad.

Hereinafter, referring now to the accompanying drawings, the preferred embodiment of the present invention is explained in detail. FIG. 1 is a perspective view showing an essential part of the first embodiment of the present invention. A reference numeral 1 denotes a flat camera body, on one side surface of which there are provided a pair of strap rings 2 aligned in a direction of photographing axis. A strap 3 is inserted into these strap rings 2, and one end of the strap 3 is further inserted into a pad 4.

This pad 4 serves not only as a hand pad but also a shoulder pad. Both ends of the strap 3 are inserted into a stopper 5 and, in turn, connected by an end fastener 6. The pad 4 is formed in a crescent cross-sectional shape when its cross section is taken in an axial direction. And the crescent cross section has substantially the same length as a size of the camera body 1 in a direction of the photographing axis. The strap 3 is inserted into an insertion hole 41 formed in the pad 4 along a longitudinal direction of the pad 4.

The stopper 5 is made of resin material etc., and comprises, as illustrated in FIGS. 3(*a*) and 3(*b*), a stopper main body 51 of rectangular cylinder, and a push button 53 supported into the stopper main body 51 by applying biasing force of a coil spring 52. There are formed through-holes 54, 55 on the stopper main body 51 and the push button 53, respectively.

In these through-holes 54, 55, both ends of the strap 3 are inserted from the same direction. The stopper 5 is constructed in such a manner that these through-holes 54, 55 are aligned on a straight line when the push button 53 is pressed down in the stopper main body 51 as shown in FIG. 3(*b*), and to the contrary, these through-holes 54, 55 are positioned as shown in FIG. 3(*a*) so as to offset with each other when the push button 53 is not pushed because the push button 53 is protruded by the action of coil spring 52.

Therefore, the strap 3 can be moved to slide in the through-holes 54, 55 or inserted into or pulled out of the through-holes 54, 55 when the push button 53 is pressed down, but the strap 3 is firmly fixed in the stopper 5 so as not to move in the through-holes 54, 55 when the push button 53 is not pushed.

The end fastener 6 is composed, as illustrated in FIG. 4, of a double-foldable plate-like clip 61 having a pair of projections 62, 62 which are coupled into holes 31, 31 opened on both ends of the strap 3 and a pair of recesses 63, 63 mating with the projections 62, 62, respectively.

Thus, at first, one of ends of the strap 3 is coupled into these two projections 62, 62, and the other of ends of the strap 3 is also coupled into these two projections 62, 62 so as to be piled up on said one of ends of the strap 3. Then, the clip 61 is folded until the projections 62, 62 are coupled into the recesses 63, 63. As a result, the strap 3 is formed in a loop shape by connecting its both ends by means of the end fastener 6.

In a strap constructed as described above, as shown in FIG. 1, the strap 3 is formed into a loop shape by the end fastener 6, and the stopper 5 divides this strap 3 into two loops L1 and L2 on both sides thereof. Further, the stopper 5 can be slid along a longitudinal direction of the strap 3 if the push button 53 is pressed down, therefore the loops L1 and L2 are changed their lengths relatively.

Accordingly, for example as shown in FIG. 5(*a*), if the stopper is shifted adjacent to the camera body, there are formed a small loop L1 at one side and a large loop L2 at the other side. The small loop L1 is equipped with the pad 4. In this condition, the pad 4 is used as a hand pad for receiving a back of hand, as shown in FIG. 5(*b*). That is, the small loop L1 serves as a grip strap.

As a result, the other large loop L2 can be used as a shoulder strap by hanging it on a shoulder as shown in FIG. 5(*c*). In other words, by adjusting the strap 3 as described above, the user of the camera can carry the camera by using the strap as a shoulder strap when the camera is not photographing. On the contrary, the strap 3 is used for holding the camera as a grip strap during photographing operation of camera.

On the other hand, as shown in FIG. 6(*a*), if the stopper 5 is shifted adjacent to the end fastener 6, the loop L1 having the pad 4 is enlarged, and the loop L2 including the end fastener 6 is shortened. Accordingly, in this condition, the pad 4 can be used as a shoulder pad as shown in FIG. 6(*b*). That is, the user can carry the camera through the loop L1. And, the small loop L2 acts as an adjusting portion for determining the length of the loop L1. This adjustment is accomplished by simply sliding the stopper 5 so as to change its position with respect to the strap 3. This arrangement is advantageous when carrying camera for fairly long time because the pad 4 is made soft and can effectively diffuse load of camera weight.

Furthermore, aforementioned two strap conditions can be easily changed by adjusting stopper position, therefore strap adjustment can be extremely easily carried out in accordance with various aspects of camera usage.

FIG. 7 is a perspective view showing an essential part of a second embodiment of the present invention. In the drawing, the same portion is suffixed by the same reference numeral as the first embodiment. In this embodiment, a pad 4A is formed to be used not only as a hand pad receiving a back of hand but also a shoulder pad. As shown in FIG. 8, this pad 4A is opened an pulling-out hole 42 on a central portion of an outer side thereof in addition to the insertion hole 41 opened at both ends thereof so that the pulling-out hole 42 can be communicated with the insertion hole 41 in the pad 4A.

The strap 3 is inserted into the insertion hole 41 from one end thereof and then, guided into the pulling-out hole 42 and pulled out from this pulling-out hole 42.

The strap 3 inserted into the pad 4A from both ends of the insertion holes 41 are gathered together and bound by the stopper 5 after being pulled out from the pulling-out hole 42.

In accordance with this arrangement, as shown in FIG. 7, the stopper 5 forms one loop L1 including the stopper 5 at one side, and forms another loop L2 with the end fastener at the other side.

Accordingly, for example as shown in FIG. 9(*a*), if the stopper is shifted adjacent to the pulling-out hole 42 of the pad 4A, there are formed a small loop L1 at one side and a large loop L2 at the other side. The small loop L1 is equipped with the pad 4A, and the large loop L2 is fixed by the end fastener 6. In this condition, the pad 4A can is used as a hand pad for receiving a back of hand, as shown in FIG. 9(*b*). That is, the small loop L1 serves as a grip strap.

On the other hand, the other large loop L2 can be used as a shoulder strap by hanging it on a shoulder as shown in FIG. 9(*c*). In other words, by adjusting the strap 3 in this fashion as described above, the user can carry the camera by using the strap 3 as a shoulder strap when the camera is not photographing. On the contrary, the strap 3 is used to hold the camera as a grip strap during photographing operation of camera.

On the other hand, as shown in FIG. 10(*a*), if the stopper 5 is shifted adjacent to the end fastener 6 together with the pad 4A, the loop L1 having the pad 4A is enlarged, and the loop L2 including the end fastener 6 is shortened. Accordingly, in this condition, the pad 4A can be used as a shoulder pad as shown in FIG. 10(*b*) so that the camera can be hung by the loop L1. And, the small loop L2 acts as an adjusting portion for determining the length of the loop L1. This adjustment is performed by simply sliding the stopper 5 so as to change its position with respect to the strap 3. This arrangement is advantageous when carrying camera for fairly long time because the pad 4 is made soft and can effectively diffuse load of camera weight.

Furthermore, aforementioned two strap conditions can be easily changed by adjusting stopper position, therefore strap adjustment can be extremely easily carried out in accordance with various aspects of camera usage.

Moreover, in this second embodiment, the stopper 5 is accurately positioned just on the pad 4A together with the end fastener 6. Therefore, this embodiment is further advantageous in that the stopper 5 is no longer an obstacle, and thus this is superior when compared with the first embodiment.

Still further, regarding the construction of the stopper, the stopper can be substituted by a different stopper. FIGS. 11(*a*) through 11(*e*) are views showing a second embodiment of the stopper. In the drawings, a stopper 5A includes a cylindrical main body 511, which is provided with a pair of openings 512, 512 on opposite sides of the cylindrical surface thereof. The strap 3 is inserted into the openings 512, 512.

In this main body 511, there is provided a lever 513 having an elliptic cross section. This lever 513 is integrally formed with one side cap 515 having a knob 514 so that the lever 513 can be rotatable together with the knob 514 by manipulating the knob 514. The side cap 515 is rotatably fitted into one opening of the cylindrical main body 511, and the other opening of the cylindrical main body 511 is fitted by the other side cap 516. And, the distal end of the lever 513 is inserted into a recess opened on the side cap 516, as shown in FIG. 11(*d*). Thus the stopper 5A is assembled by simply coupling there three parts; i.e. the cylindrical main body 511, and a pair of side caps 515, 516, as shown in FIG. 11(*c*).

In this second embodiment of the stopper, when the stopper 5A is positioned at a first position as shown in FIG. 11(*b*) in which the lever 513 expands the straps 3 in the cylindrical main body 511 so as to give larger frictional force to prevent the strap 3 from moving, the straps 3 can be firmly fixed.

On the other hand, by turning 90 degree from the first position, the stopper 5A is positioned at a second position, as shown in FIG. 11(*e*), in which the lever 513 loosens the straps 3 in the cylindrical main body 511 so as to minimize the frictional force to allow the strap 3 moving, thus the straps 3 can be moved to change stopper position with respect to the strap 3.

Moreover, the stopper can be substituted by another different stopper. FIGS. 12(*a*) through 12(*c*) are views showing a third embodiment of the stopper. In the drawings, a stopper 5B includes a substantially triangular main body 521, which is provided with an opening 522 on its pinnacle and a pair of openings 523, 523 on its bottom surface. The strap 3 is inserted from respective bottom openings 523, 523 to the pinnacle opening 522.

In this main body 521, there is provided a stopping member 524 consisting of a gear extending in an axial direction. This stopping member 524 is slidably coupled into guide grooves 525, 525 opened on the main body 521 at both ends thereof so that the stopping member 524 can be shifted along a line extending from the pinnacle to the bottom.

In this third embodiment of the stopper, when a stopping member 524 is positioned at a first position closer to the pinnacle as shown in FIG. 12(*b*), the stopping member 524 bites the straps 3 in the main body 521 so as to give larger frictional force to prevent the strap 3 from moving, the straps 3 can be firmly fixed. In this case, the stopping member 524 is designed its size so that the stopping member 524 can elastically press-fitted into the wedge-shaped narrow space near the pinnacle opening 522 in the first position.

Namely, if the stopping member 524 is pushed toward the pinnacle opening 522, the stopping member 524 sticks into the wedge-shaped narrow space. That is, the straps 3, 3 are sandwiched by the stopping member 524 and the main body 521, respectively. On the other hand, if the stopping member 524 is pushed toward the bottom openings 523, 523, the stopping member 524 is released from the engagement with the wedge-shaped narrow space. As well, the straps 3, 3 are also released in accordance with the disengagement of the stopping member 524.

That is, by shifting the stopping member 524 toward the bottom openings 523, 523 from the first position, the stopping member 524 is positioned at a second position in which the stopper member 524 loosens the straps 3 in the main body 521 so as to minimize the frictional force to allow the strap 3 moving, thus the straps 3 can relatively change stopper position.

As is explained in the foregoing description, in accordance with present invention, there is provided a strapping structure for an optical instrument and the like comprising a loop-shaped strap which is installed on an optical instrument body, a stopper provided on an intermediate portion of the loop-shaped strap, said stopper being shiftable along a longitudinal direction of said strap, and said stopper forming a large loop-shaped first strap serving for example as a shoulder strap and a small loop-shaped second strap serving for example as a grip strap.

The loop-shaped strap, which is positioned adjacent to the optical instrument, is provided with a pad. This pad can be used as a pad receiving a back of hand or a shoulder pad.

Therefore, it becomes possible to provide a strapping structure for an optical instrument and the like, for example a camera, a video camera, a binocular and so on, which is capable of performing as more than two straps having different functions such as a grip strap and a shoulder strap.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A strapping structure for an instrument comprising:

a loop-shaped strap adapted to be installed on said instrument;

a pad;

a stopper provided on an intermediate portion of said loop for binding said loop to form a first loop portion and a second loop portion, said strap passing through said pad into said stopper, said stopper being shiftable along a longitudinal direction of said strap, whereby said first and second loop portions may be varied with respect to each other so that said pad can be positioned to serve as a hand pad or a shoulder pad wherein both ends of said strap are inserted into said stopper and connected by an end fastener; and said end fastener is composed of a double-foldable clip which is formed with engaging means for engaging with the ends of said strap.

2. The strapping structure according to claim 1, wherein said stopper is made of resin material.

3. The strapping structure according to claim 1, wherein said stopper comprises a stopper main body, a coil spring and a push button supported into the stopper main body by applying biasing force of the coil spring.

4. The strapping structure according to claim 3, wherein there are formed through-holes on the stopper main body and the push button, respectively, and both ends of the strap are inserted in these through-holes.

5. The strapping structure according to claim 4, wherein said stopper is constructed in such a manner that these through-holes are aligned on a straight line when the push button is pressed down in the stopper main body, and to the contrary, these through-holes are positioned so as to offset with each other when the push button is not pushed, so that the strap can be moved to slide in the through-holes or inserted into or pulled out of the through-holes when the push button is pressed down, but the strap is firmly fixed in the stopper so as not to move in the through-holes when the push button is not pushed.

6. The strapping structure according to claim 1, wherein said pad has a crescent-shaped cross section.

7. The strapping structure according to claim 6, wherein said pad includes insertion holes at the longitudinal ends thereof and said strap is inserted into said insertion holes from opposite longitudinal directions of the pad.

8. The strapping structure according to claim 1, wherein said end fastener is composed of a double-foldable plate-like clip having a pair of projections which are coupled into holes located at both ends of the strap and a pair of recesses mating with the projections, respectively.

* * * * *